US006581973B2

(12) United States Patent
Levine et al.

(10) Patent No.: US 6,581,973 B2
(45) Date of Patent: Jun. 24, 2003

(54) DOUBLE BLIND STUDY LABEL

(75) Inventors: Jeffrey M. Levine, Woodcliff Lake, NJ (US); Harvey Cheringal, Norwood, NJ (US); William Cheringal, Old Tappan, NJ (US); Russell Vizzi, Closter, NJ (US)

(73) Assignee: Cheringal Associates, Inc., Norwood, NJ (US)

( * ) Notice: Subject to any disclaimer, the term of this patent is extended or adjusted under 35 U.S.C. 154(b) by 126 days.

(21) Appl. No.: 09/823,143

(22) Filed: Mar. 30, 2001

(65) Prior Publication Data

US 2003/0075918 A1 Apr. 24, 2003

(51) Int. Cl.[7] ..... B42D 15/00

(52) U.S. Cl. ..... 283/81; 40/310; 283/101; 283/105; 283/901

(58) Field of Search ..... 283/74, 75, 79, 283/80, 81, 101, 105, 56, 100, 102, 901; 40/299, 310

(56) References Cited

U.S. PATENT DOCUMENTS

| | | | | |
|---|---|---|---|---|
| 3,166,186 A | | 1/1965 | Karn | |
| 3,386,846 A | | 6/1968 | Lones | |
| 4,128,954 A | | 12/1978 | White | |
| 4,188,250 A | | 2/1980 | Grass | |
| 4,312,523 A | | 1/1982 | Haines | |
| 4,584,219 A | | 4/1986 | Baartmans | |
| 4,637,635 A | * | 1/1987 | Levine | 283/101 |
| 4,700,976 A | * | 10/1987 | Loose | 283/101 |
| 4,727,667 A | | 3/1988 | Ingle | |
| 4,763,930 A | * | 8/1988 | Matney | 283/81 |
| 4,964,513 A | | 10/1990 | Ingram et al. | |
| 5,056,827 A | | 10/1991 | Sasso | |
| 5,219,183 A | | 6/1993 | McKillip | |
| 5,275,871 A | | 1/1994 | Hambright | |
| 5,366,249 A | | 11/1994 | Diemert | |
| 5,640,447 A | * | 6/1997 | Fonseca | 379/144 |
| 5,829,789 A | | 11/1998 | Treleaven et al. | |

* cited by examiner

*Primary Examiner*—Willmon Fridie, Jr.
(74) *Attorney, Agent, or Firm*—Caesar, Rivise, Bernstein Cohen & Pokotilow, Ltd.

(57) ABSTRACT

A double blind study label for use in, e.g., a drug study. A first portion of the label, identifying the test drug, is coupled to a vial containing either the test drug or a placebo. The second portion of the label identifies the actual contents of the vial, along with instructions in case of an adverse reaction, but all of which is concealed by an scratch-off, opaque layer. The second portion is severed from the first portion and held by the testing agency. Thus, every participant believes he/she is taking the drug under test. Should the participant suffer and adverse reaction, the testing agency can be contacted whereby the opaque layer is scratched off the emergency instructions relayed to the participant.

13 Claims, 9 Drawing Sheets

DOUBLE BLIND STUDY LABEL

FIELD OF THE INVENTION

This invention relates generally to the field of labels, and more particularly, to labels, and methods for making such labels, that comprise a first label portion having an opaque film covering information thereon and which can be applied to a first item and a second, severable label portion having other related information that can be applied to a second item such as a record book or file.

BACKGROUND OF THE INVENTION

The use of labels that can be applied to a container (e.g., a medicine bottle) or luggage and which include a portion that can be torn off and then stored in a folder, in a record book or just held by a person as a receipt, are known. For example, see U.S. Pat. Nos. 4,128,954 (White); 4,312,523 (Haines); 4,964,513 (Ingram et al.); 5,056,827 (Sasso); 5,366,249 (Diemert); and 5,829,789 (Treleaven et al.).

Furthermore, the use of selective-adhesive back portions for labeling is also known in the art. For example, see U.S. Pat. Nos. 3,166,186 (Karn); 3,386,846 (Lones); 4,188,250 (Grass); 4,312,523 (Haines); 4,584,219 (Baartmans); and 4,727,667 (Ingle).

U.S. Pat. No. 5,275,871 (Hambright) discloses an image producing and transfer apparatus that utilizes "kiss cutting" which comprises die cutting through only the thickness of the face sheet but not cutting through the tacky adhesive layer and backing.

U.S. Pat. No. 5,219,183 (McKillip) discloses a printable sheet having a separable card. In particular, this patent discloses a printable sheet having a face sheet that adheres to a backing sheet using a layer of adhesive. The rear surface of the face sheet is pattern coated with a release agent only in regions disposed in registration with the cards to be formed as portion of the face sheet. A cut line is formed through the face sheet along the perimeters of the cards so that the cards may be readily peeled away leaving the remainder of the face sheet adhered to the backing sheet.

However, there remains a need for a label that conceals pre-printed information under normal circumstances but which can be easily revealed in an emergency situation, and also includes an associated severable portion that can be remotely stored or secured to another item.

SUMMARY OF THE INVENTION

A label comprising a first portion having a first front portion and a first back portion wherein the first back portion is adapted for coupling to one item (e.g., a container, test tube, etc.); a second portion, severable from the first portion and wherein the second portion has a second front portion and a second back portion whereby the second back portion is adapted for coupling to a second item (e.g., a notebook, a file folder, etc.); and wherein the second front portion comprises information thereon that is covered by an opaque layer that can be removed for revealing the information.

A matrix for providing at least one dual portion label that is adapted for removal therefrom for coupling to an item (e.g., a container, test tube, etc.). The matrix comprises: a face stock releasably attached to a release sheet wherein the face stock is cut to form the perimeter of the at least one dual portion label and whereby the face stock within the perimeter is perforated to form a first label portion and a second label portion; the second label portion is severable from the first label portion once the at least dual portion label is removed from the matrix; the release sheet has a release sheet portion that is releasably coupled to the second label portion whereby the release sheet portion is releasably interconnected (e.g., shot tabs) with the release sheet; and wherein the second label portion comprises information thereon that is covered by an opaque layer that can be removed for revealing the information.

A method for making labels that are adapted for coupling to an item (e.g., a container, test tube, etc.) and wherein each of the labels includes a first portion that is adapted to couple to the item and a second portion that can be removed from the label for coupling to another item (e.g., a notebook, a file folder, etc.) and wherein the second portion contains information that is concealed. The method comprises the steps of: (a) providing a face stock and a release sheet that are coupled together by an adhesive on one side of the face stock; (b) cutting the exposed side of the face stock to form a plurality of labels each having a respective perimeter; (c) perforating each of the labels to form the first portion and the second portion; (d) cutting the release sheet under the second portion to form a release sheet portion under the second portion; (e) placing information on the second portion; and (f) applying an opaque layer over the information on the second portion.

DESCRIPTION OF THE DRAWINGS

Many of the attendant advantages of this invention will be readily appreciated as the same becomes better understood by reference to the following detailed description when considered in connection with the accompanying drawings wherein.

DESCRIPTION OF THE PREFERRED EMBODIMENT OF THE INVENTION

Figure 1:
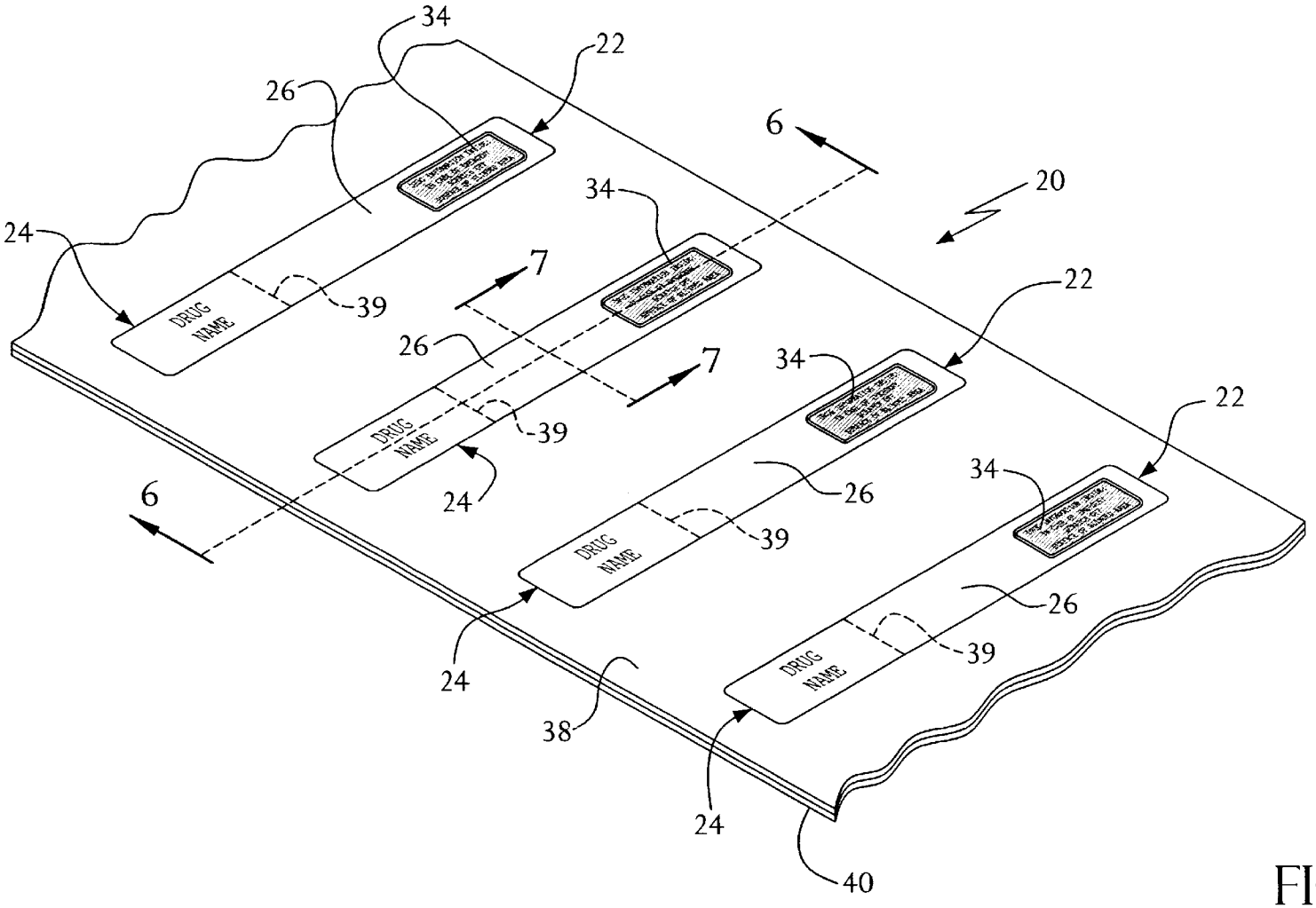
FIG. 1 is a partial isometric view of a matrix containing a plurality of dual portion labels.
Figure 2:
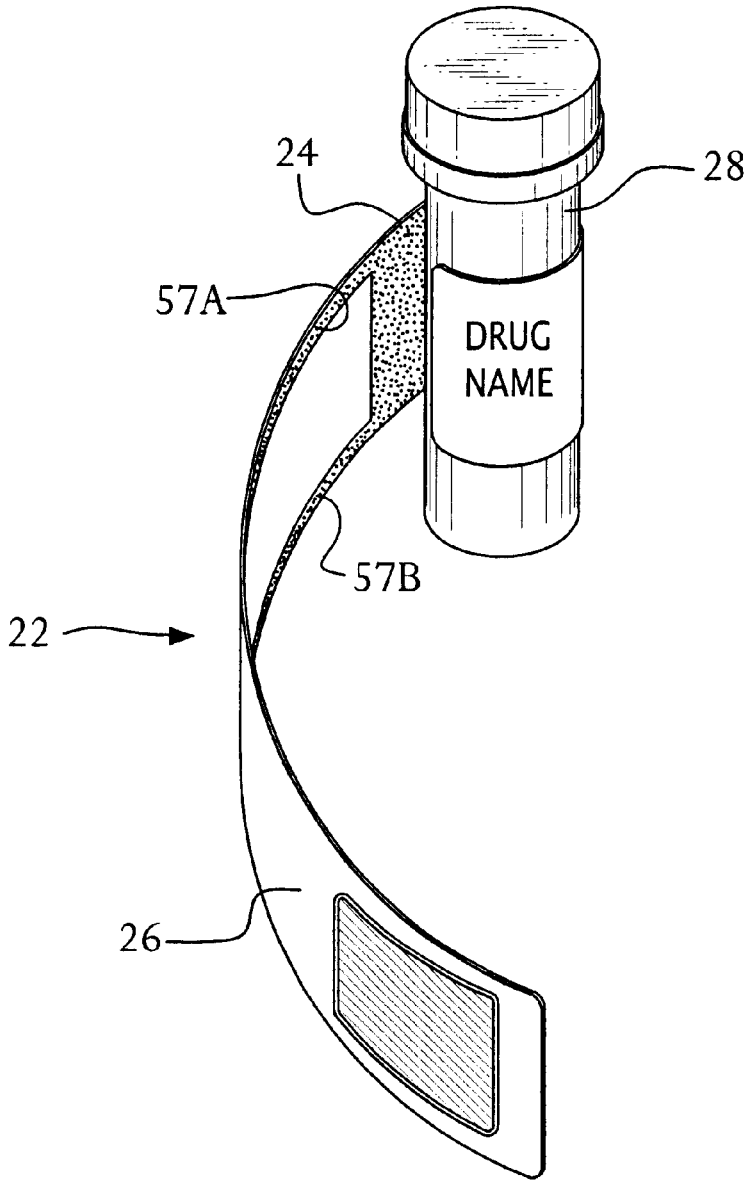
FIG. 2 is an isometric view showing how a dual portion label from the matrix is applied to a first item, e.g., container, a vial, etc.

Referring now in greater detail to the various figures of the drawing wherein like reference characters refer to like parts, there is shown in FIG. 1 a label matrix 20 constructed in accordance with the present invention and comprising a plurality of dual panel or portion labels 22 that are releasably secured therein. Each dual portion label 22 comprises a first portion 24 and a severable second portion 26. As will be discussed in detail later, the first portion 24 may contain a first set of information and the second portion 26 may contain a second set of related information that is concealed by an opaque layer. Once the entire dual portion label 22 is removed from the label matrix 20, the first portion 24 can be applied to a first item (see FIG. 2). The second portion 26 can then be severed from the first portion 24 and stored in, or even applied to, a second item.

Figure 3:
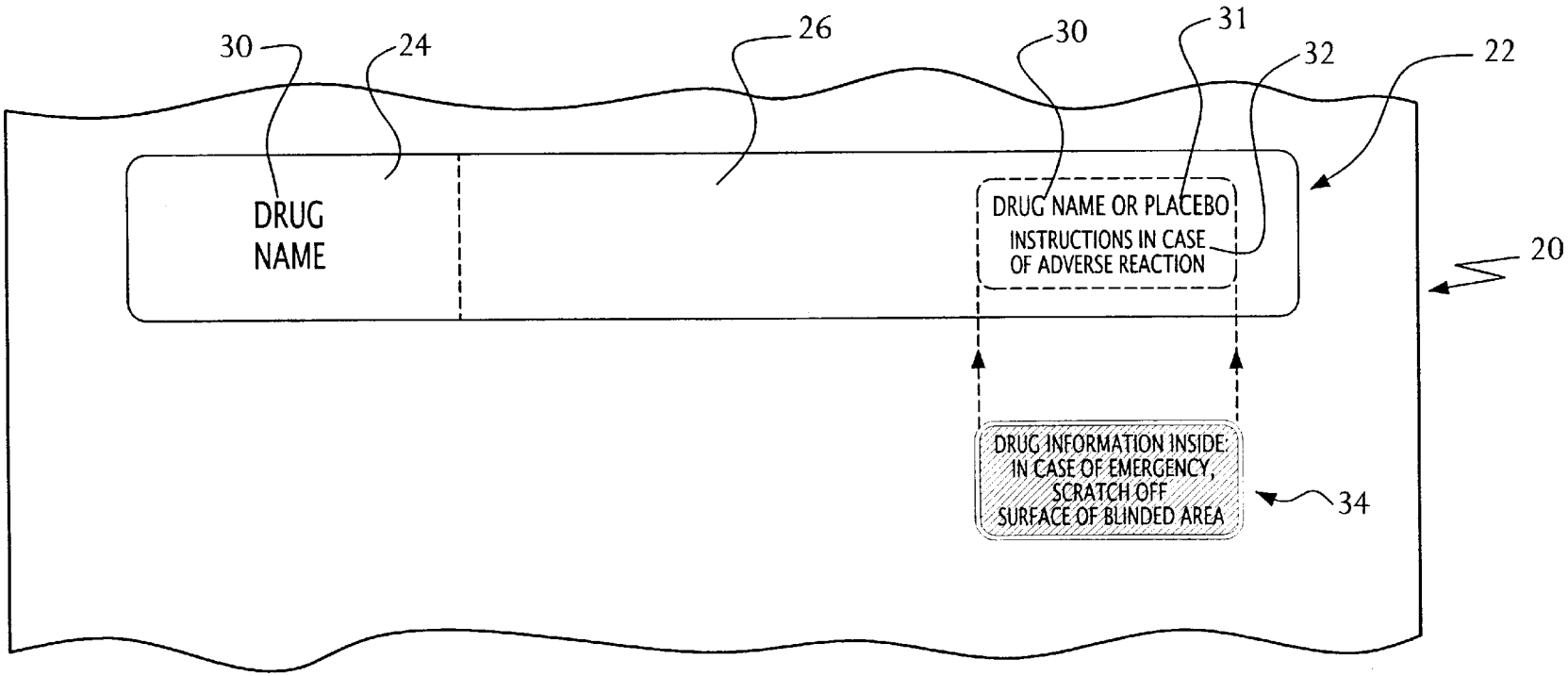
FIG. 3 is a top plan view of the dual portion label of the label matrix showing information on the first portion and information on the second portion to be concealed by an opaque layer.

One example application of the dual portion label 22 is in the study or clinical trial of a pharmaceutical to determine its effects on the physiology of a living being. In particular, a testing agency, or the pharmaceutical manufacturer, deposits a pharmaceutical in a first set of vials and deposits a placebo in a second set of vials; an example of one of these vials is shown at reference number 28 in FIG. 2. As shown most clearly in FIG. 3, for those labels 22 that are applied to the first set of vials, i.e., those actually containing the pharmaceutical under test, the information printed on the second portion 26 contains the identity of the pharmaceutical 30 along with directions 32 in case of an adverse reaction (e.g., if swelling occurs, apply ice, etc.); alternatively, for those labels 22 that are applied to the second set of vials, i.e., those containing the placebo, the information printed on the second portion 26 contains the word "placebo." In either case, an opaque layer 34, similar somewhat to those used on lottery tickets, is then applied over top of the information 30/32 or information 31, on the second portion 26 only. The first portion 24 of the labels 22 contain the identity of the pharmaceutical under test and is not concealed. Thus, the testing agency, or pharmaceutical manufacturer, has a first set of labels 22 for application to vials 28 that contain the pharmaceutical under test and a second set of labels 22 for application to vials 28 that contain the placebo. In either case, once the entire dual portion label 22 is removed from the label matrix 20, the first portion 24 is applied to the vial 28 via an adhesive 42 on the back of the first portion 24. As mentioned earlier, the second portion 26 is severable from the first portion 24, once the dual portion label 22 is removed from the matrix 20; a perforation 39 (most clearly shown in FIG. 1) allows the user to separate the second portion 26 from the first portion 24, as will also be discussed later. Once the second portion 26 is severed from the first portion 24, the second portion 26 can be stored or affixed in a laboratory book, or record book or file folder, etc., for proper tracking during the clinical trial or study. It should be understood that the testing agency, or pharmaceutical manufacturer, includes indicia that correlates the severed second portion 26 to the corresponding first portion 24 that is on the vial 28 to accomplish the proper tracking.

Next, these two sets of vials are randomly distributed to a test population with all of the participants knowing the identity of the pharmaceutical under test via the information 30 that appears on the first portion 24 which is on the vial 28 received. However, the participant has no way of knowing the actual contents of the vial 28 and could be taking either the pharmaceutical under test or the placebo. If a participant taking the pharmaceutical under test were to suffer an adverse reaction, he/she can call the testing agency/pharmaceutical manufacturer, and that entity will then immediately scratch off the opaque layer 34 corresponding to the first portion 24 of the label 22 applied to that participant's vial 28, and give the proper instructions to remedy the adverse reaction. The scratched-off opaque layer 34 also serves as an indicator to the testing agency/pharmaceutical manufacturer to void that participant's data. Otherwise, if the participant finishes taking all of the pharmaceutical/placebo, the vial 28 is returned to the testing agency/pharmaceutical manufacturer for analysis.

Figure 3A:
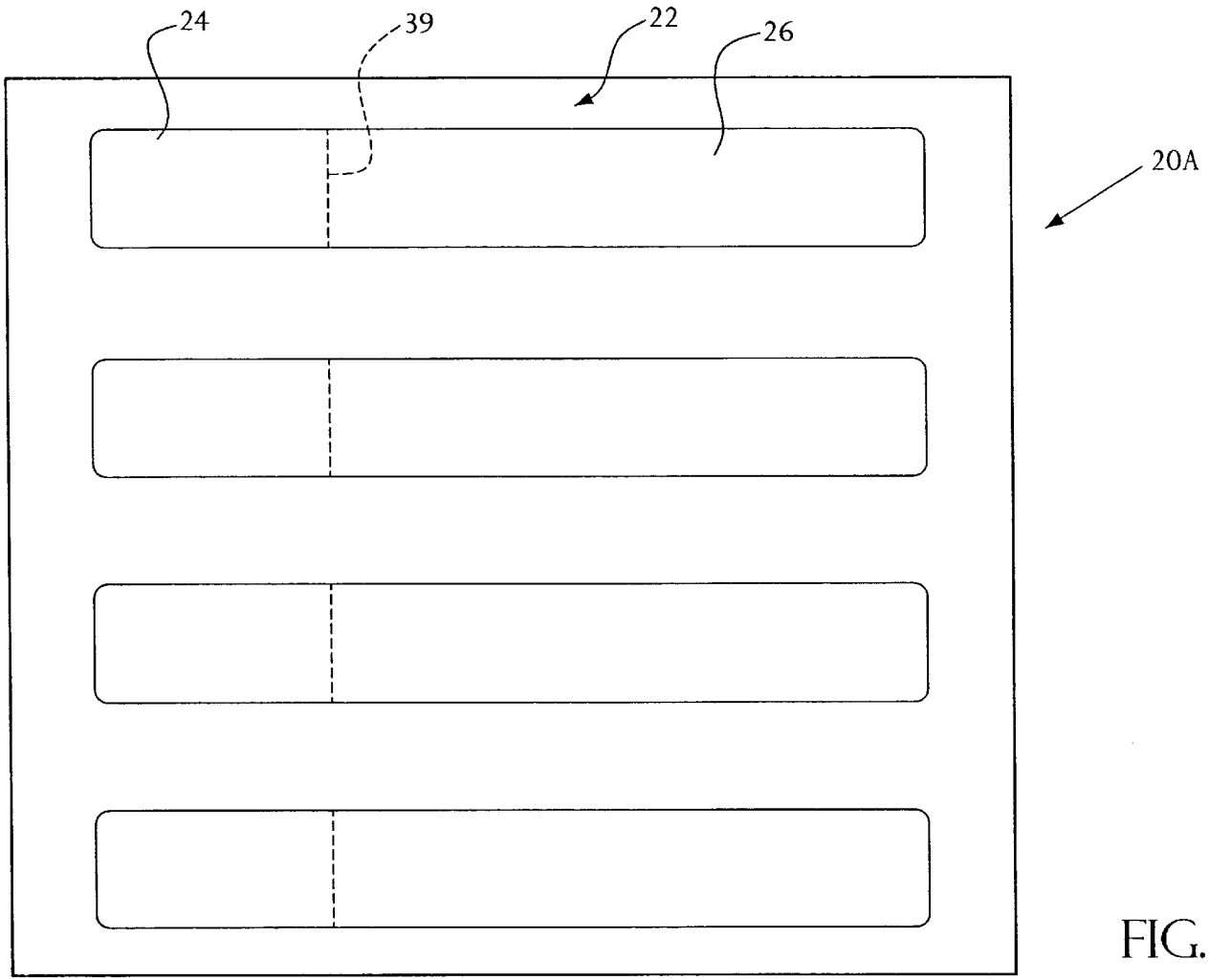
FIG. 3A is a top plan view of the label matrix before there is any printing thereon referred to as the "label structure"
Figure 3B:
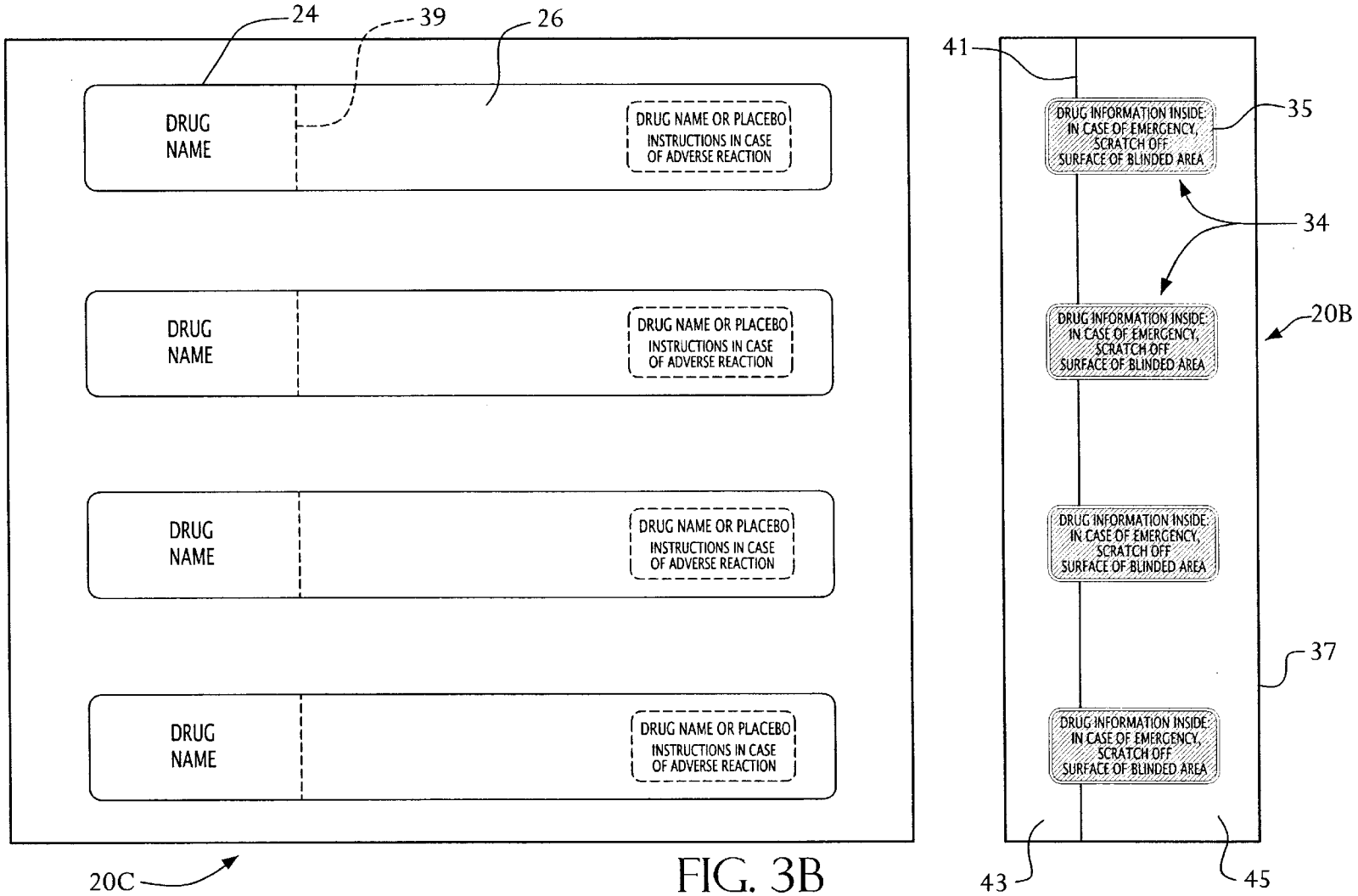
FIG. 3B is top plan view of the label structure of FIG. 3A with printing thereon and an opaque layer matrix adjacent thereto.

The label matrix 20, as shown in FIG. 1, is generated by creating a label structure 20A (FIG. 3A), then printing the appropriate information on the label structure 20A to form a printed label structure 20C (FIG. 3B), and then applying the opaque layers 34 from an opaque layer matrix 20B (FIG. 3B) to the printed label structure 20C to cover the appropriate information. In particular, the Assignee of the present invention, namely, Control Pharmaceutical, provides the label structure 20A and the opaque layer matrix 20B to the testing agency or the pharmaceutical manufacturer, etc. The testing agency or the pharmaceutical manufacturer then takes the label structure 20A and feeds it into a sheet fed printer (e.g., a laser printer, a pin feed hole printer, etc.) which generates the information 30, 31 or 32 accordingly and in the appropriate first 24 or second 26 portions of the dual portion label 22 to form the printed label structure 20C (FIG. 3B). Next, the testing agency or the pharmaceutical manufacturer then applies the opaque layer matrix 20B to cover the information 30/32 or 31 on the second portion 26 only.

Figure 4:
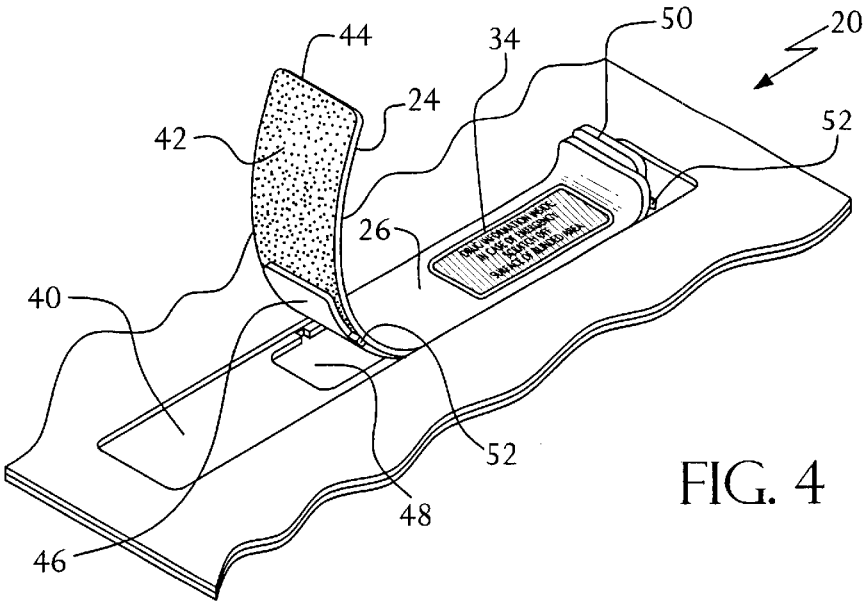
FIG. 4 is an isometric view showing the first portion of the dual portion label being pulled away from the release sheet and also showing a second portion of the dual portion label being pulled away from the shot tabs.

The label structure 20A (e.g., 8.5"×11", or a fan-fold sheet having pin feed holes, etc. ) basically comprises a face stock material 38 and a release sheet 40, whereby the release sheet 40 is releasably secured, e.g., an adhesive 42 (e.g., FIG. 4). It is preferable to use a dark, opaque pressure sensitive adhesive. This prevents any non-clinical trial personnel from determining the concealed information by attempting to read the concealed information from the back side of the second portion 26 (e.g., by holding it up to a bright light.) while it is in the label matrix 20, or if the second portion were applied to a vial 28 that is transparent, etc.

An example of such a label structure 20A is Trans-Therm 1C Label No. 12906 which is manufactured by Avery Dennison of Painesville, Ohio. In particular, the Trans-Therm 1C comprises: (1) a thermal transfer face stock; (2) Avery Dennison adhesive S2501 which is an acrylic emulsion; and (3) 45-pound SCK release liner which is a bleached sulfate super-calendered paper stock. The label structure 20A is obtained in a roll form and then die cut, as will be explained later, to form the label structure 20A. It should be understood that the Trans-Therm 1C is by way of example only and does not limit the scope of the invention to that particular label structure 20A or any of its components. Thus, each dual portion label 22 is formed from the face stock material 38. The formation of the label structure 20A is discussed later.

The opaque layer matrix 20B (FIG. 3B) comprises a clear plastic, self-adhesive label material. In particular, the opaque layer matrix 20B includes (1) a clear plastic layer 35, (2) and adhesive(not shown) and (3) release liner 37. The clear plastic layer 35 is subjected to four different layers of ink to generate the "dark, opaque layer 34 and the information "Drug Information Inside: In Case of Emergency Scratch Off, Surface of Blinded Area," that resides on top of the opaque layer 34.

Next, the clear plastic layer 35 is die cut to form the substantially-rectangular shaped opaque layer 34 that is applied to the second portion 26 of the dual portion label 22 to cover the information 30/32 or 31. Most of the clear plastic layer 35 is removed as waste. As can be seen most clearly in FIG. 3B, the outer periphery of the opaque layer 34 is what remains of the original clear plastic layer 35; this outer periphery prevents "chipping" of the opaque layer 34 ink during the die cutting stage.

Next, the release liner 37 is back-scored along a lengthwise direction to form the score line 41. Thus, the opaque layer matrix 20B is now complete.

At this stage, the Assignee then sends the label structure 20A, along with the opaque layer matrix 20B, to the testing agency or pharmaceutical manufacturer. As mentioned earlier, the testing agency/pharmaceutical manufacturer then passes the label structure 20A through a printer to print the appropriate information 30/32 and 31 in the appropriate label portions 24/26 to form the printed label structure 20C . As shown most clearly in FIG. 3B, the agency/manufacturer, then aligns the printed label structure 20C next to the opaque layer matrix 20B and removes the lead edge portion 43 of the release liner 37. This exposes the adhesive (not shown) under the left portion of the opaque layers 34 which are then positioned over the left side of the information 30/32 (or 31) on the second portion 26 and then pressure is applied to secure the left portions of the opaque layers 34 thereto; next, the remaining portion 45 of the release liner 37 is removed to expose the adhesive (not shown) under the remaining portion of the opaque layers 34 and then pressure is applied to secure the remaining portion of the opaque layers 34 to the second portions 26. Since the opaque layers 34 have been appropriately spaced during the generation of the opaque layer matrix 20B to correspond to the spacing of the dual label portions 22 in the label structure 20A, a plurality (e.g., four, as shown in FIG. 3B) of opaque layers 34 can be applied at once to a corresponding plurality (e.g., four, as shown in FIG. 3B) of second portions 26 of the dual label portions 22.

It should be noted that during the application of the four different layers of ink, the clear plastic layer 35 is also treated with an ultraviolet light-cured varnish which gives the opaque layers 34 a rub-resilient feature. In particular, unlike conventional scratch-off opaque layers, such as those used on lottery tickets, the rub-resilient feature allows any opaque layers 34 that are in contact (e.g., when the vials 28 are being shipped and may be in close proximity to one another) to rub against each other without scratching-off any part of the opaque layer 34. This varnish is a special coating that acts as a hard shell barrier that prevents such unintentional rub-off. Currently, to provide such a barrier to a conventional scratch-off layer, another clear plastic layer must be applied by the user. In contrast, the ultraviolet light-cured varnish application avoids this extra step.

Figure 5:
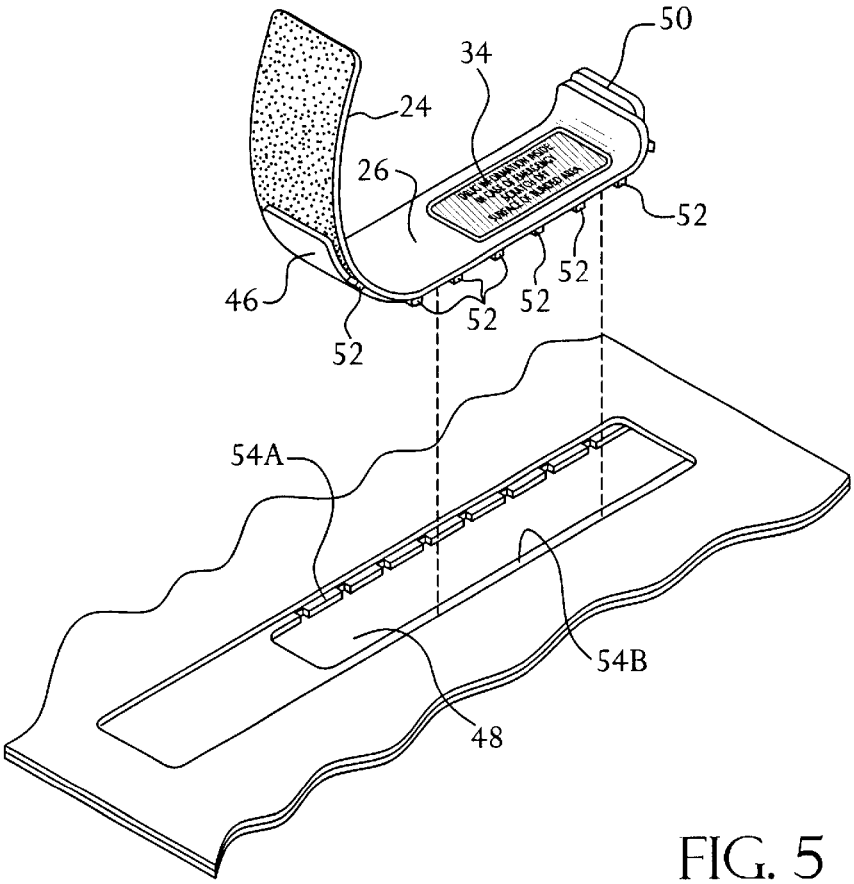
FIG. 5 is an isometric view showing the dual portion label completely removed from the label matrix.

Once the label matrix 20 (FIG. 1) is formed, FIGS. 4–5 depict how one of the dual portion labels 22 is removed from the matrix 20. As can be seen in FIG. 4, the leftmost edge 44 is first peeled upward away from the release sheet 40, revealing the adhesive 42. As the label 22 is further peeled away, a release sheet portion or layer 46 (hereinafter "release sheet portion 46") remains releasably secured to the second portion 26 of the label 22, leaving a hole 48 in the release sheet 40. Once the entire label 22 is removed from the matrix 20, an extension or projection 50 in the release sheet portion 46 is provided that facilitates separating the release sheet portion 46 from the second portion 26.

Once the label 22 is removed from the matrix 20, as mentioned earlier, the first portion 24 can be secured to a first item, e.g., vial 28 (FIG. 2), by applying the adhesive side 42 to the item; next, the second portion 26 can then be severed from first portion 24 along the perforation 39. Thus, once the second portion 26 is severed from the first portion 24, the presence of the release sheet portion 46 that accompanies the second portion 26 preserves the adhesive between the second portion 26 and the release sheet portion 46 to permit the second portion 46 to be affixed to some other item. The user need only seize the extension/projection 50 and peel away the release sheet portion 46 from the second portion 26 in order to apply the second portion 26 to some other item (e.g.,notebook, file folder, etc.). Alternatively, the release sheet portion 46 can remain releasably secured to the second portion 26 and the second portion 26 can then be stored loosely in a notebook, file folder, etc.

Figure 7:
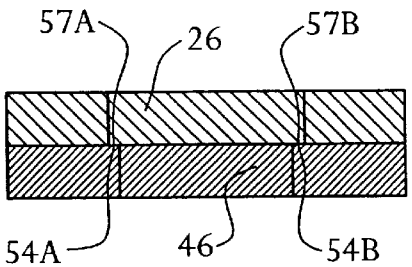
FIG. 7 is a cross-sectional view of the dual portion label in the label matrix taken along line 7—7 of FIG. 1.

As can further be seen in FIGS. 4–5, the release sheet portion 46 is itself releasably secured to the release sheet 40 via a plurality of shot tabs 52. The shot tabs 52 comprise discrete portions of the release sheet portion 46 that are not severed from the release sheet 40. Thus, the shot tabs 52 keep the release sheet portion 46 within the plane of the release sheet 40 until the label 22 is removed from the matrix 20. These shot tabs 52 can be easily severed by the user when the label 22 is peeled away from the release sheet 38. To further stabilize the second portion 26/release sheet portion 46 in the label matrix 20 until the label 22 is removed, the release sheet portion 46 has a width that is slightly smaller than the width of the second portion 26. This can be most easily seen in FIG. 5, where an upper shelf 54A and a lower shelf 54B can be seen in the release sheet 40 (see also FIG. 7).

The preferred shape of the dual portion label 22, including the first portion 24 and the second portion 26, as well as the release sheet portion 46, is substantially rectangular although it is not limited to that shape.

To make the label structure 20A, the face stock 38/release sheet 40 matrix is fed through a process that creates the first portion 24 and second portion 26, as well as the release sheet portion 46.

Figure 8:
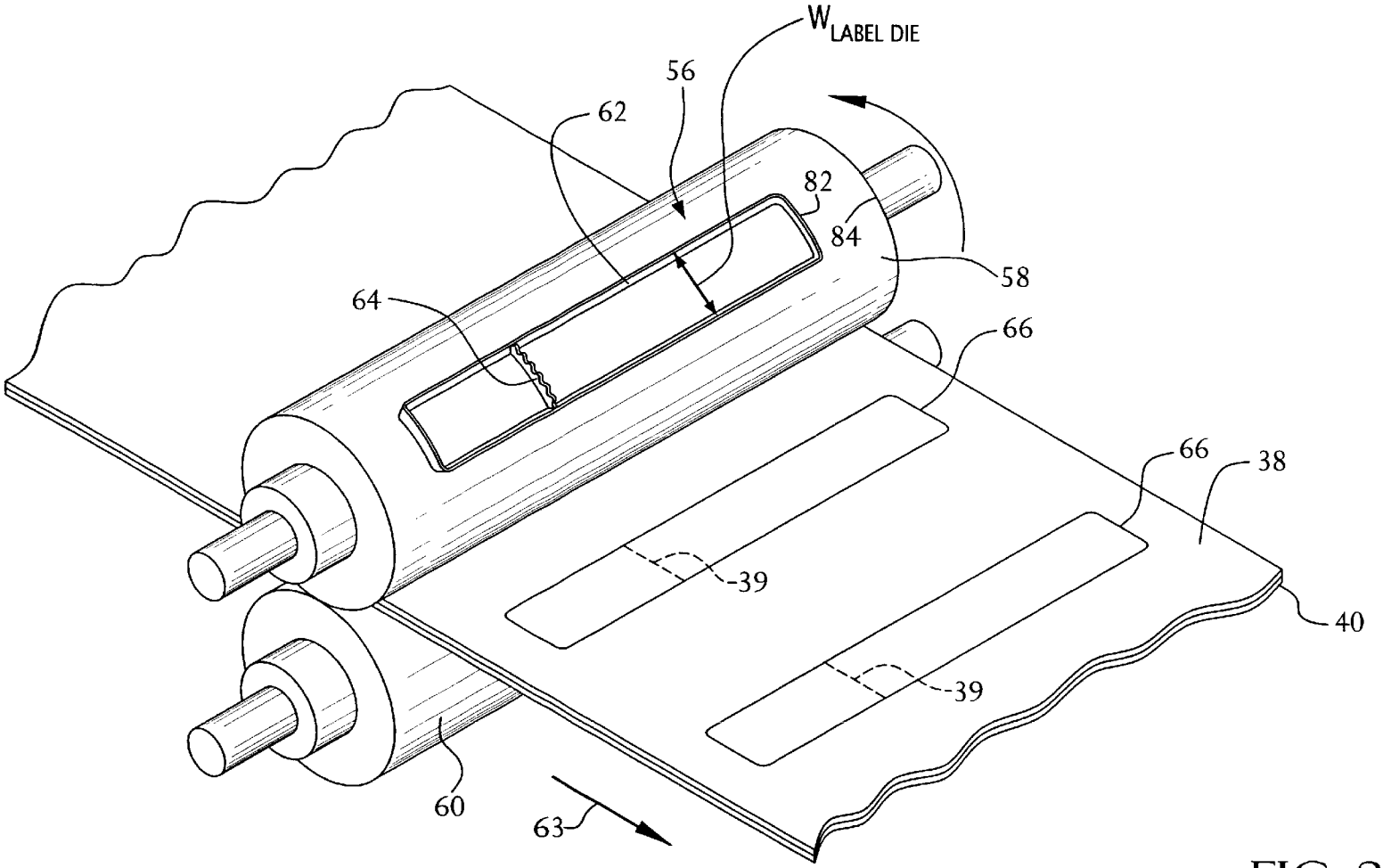
FIG. 8 is a top isometric view of the cutting die used to form the label structure.

In FIG. 8, there is shown a specialized cutting die 56 that forms a part of an upper roller 58. The cutting die 56 comprises a substantially rectangular-shaped continuous cutting member 62 having a width $W_{LABEL\text{-}DIE}$. The face stock 38/release sheet 40 matrix is fed (in the direction of arrow 63) between this upper roller 58 and a lower pressure roller 60 and whereby, at predetermined intervals, the cutting member 62 cuts the face stock material 38 to form the perimeters 66 of the dual portion labels 22. Also, there is a perforating member 64 that perforates the face stock material to form the perforation 39 in each of the dual portion labels 22.

Figure 9:
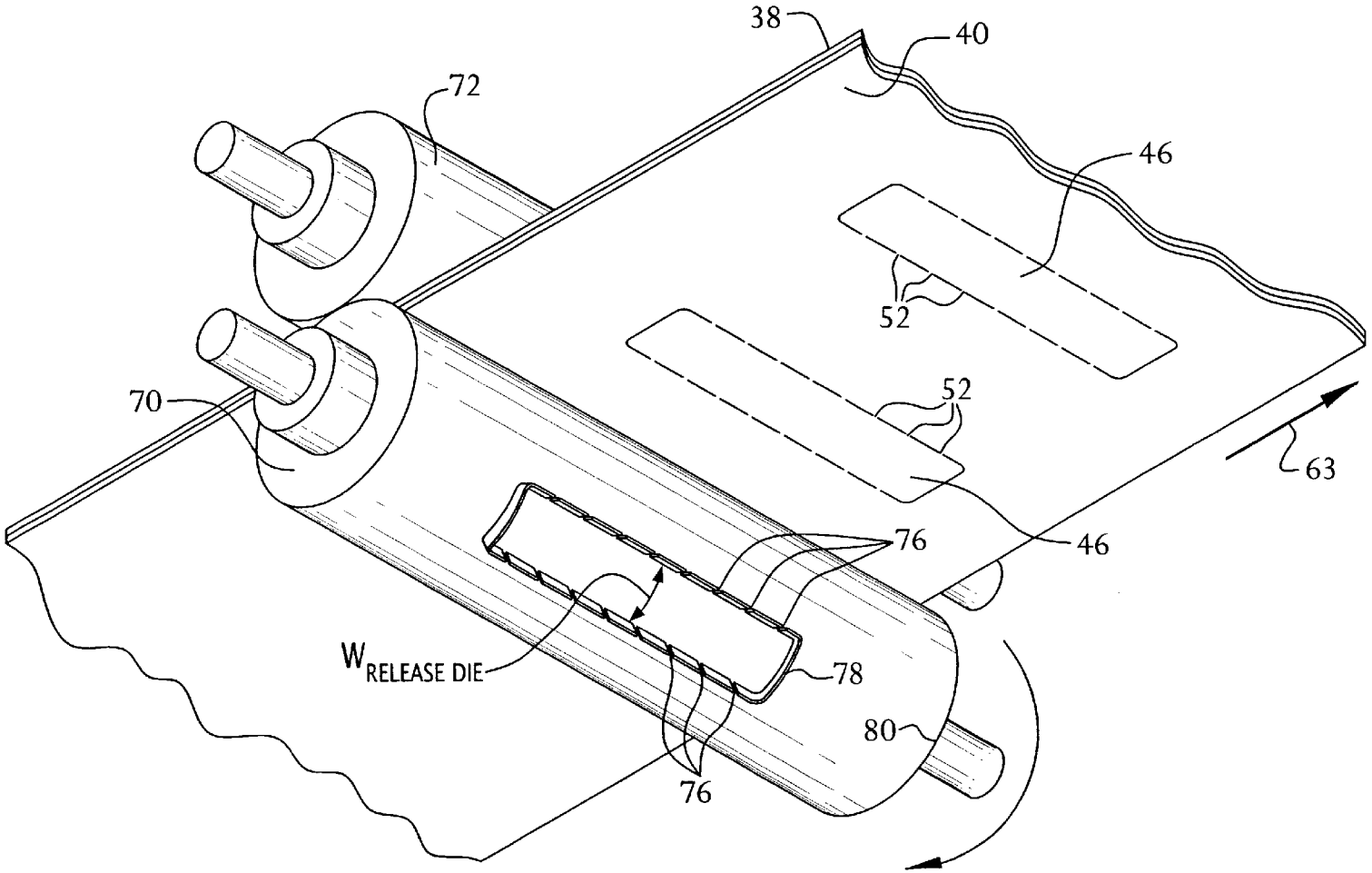
FIG. 9 is a bottom isometric view of the cutting die used to form the release sheet portion of the label structure.

In FIG. 9, there is shown a specialized cutting die 68 that forms a part of a lower roller 70. The cutting die 68 comprises a substantially rectangular-shaped, cutting member 74 having gaps 76 distributed thereout and having a width $W_{RELEASE\text{-}DIE}$. The face stock 38/release sheet 40 matrix is fed (in the direction of arrow 63) between this lower roller 70 and an upper pressure roller 72 and whereby, at predetermined intervals corresponding to the release sheet 40 directly under the second portions 26, the cutting member 74 cuts the release sheet 40 to form the release sheet portions 46, including the shot tabs 52.

It should be understood that the lower roller 70 may comprise the lower pressure roller 60 so that the face stock 38 is being cut at the same time that the release sheet 40 is also being cut, although it is not limited to such operation. Thus, for example, the face stock 38 can be cut at a first station and the release sheet 40 cut at a second station.

As mentioned earlier, shelves 54A and 54B help stabilize the dual portion label 22 in the matrix 20. These shelves 54A/54B are created because $W_{LABEL\text{-}DIE} > W_{RELEASE\text{-}DIE}$. In addition, a pair of corresponding adhesive bands 57A/57B (FIG. 2) are formed under the second portion 26 before the release sheet portion 46 is removed from the second portion 26. These adhesive bands 57A/57B may also assist in holding the dual label portion 22 to the vial 28 if wrapped around the vial 28 before the second portion 26 is severed from the first portion 24. Furthermore, the extension or projection 50 in the release sheet portion 46 is created because the cutting edge 78 of the cutting member 74 is closer to the roller edge 80 than is the cutting edge 82 of the cutting member 62 to the roller edge 84.

Figure 6:
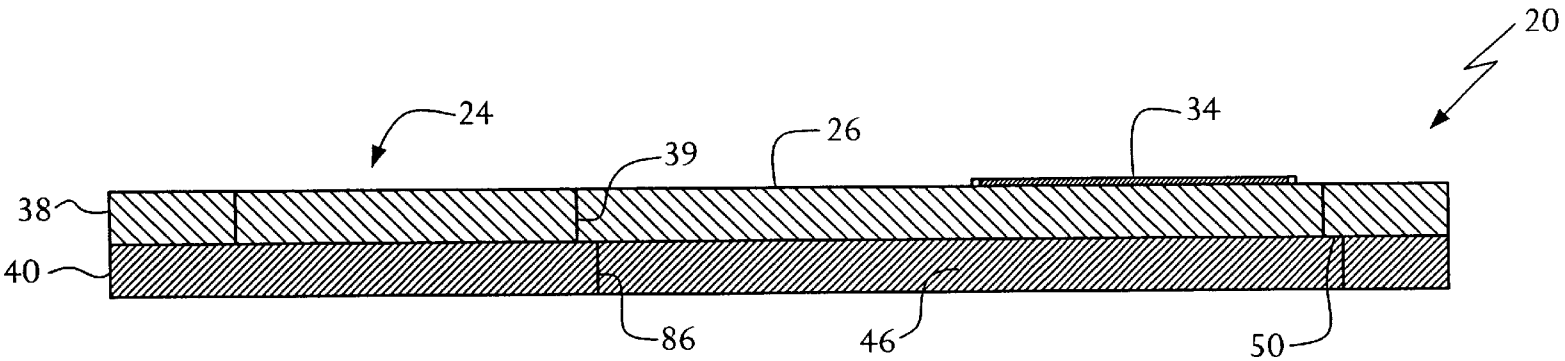
FIG. 6 is a cross-sectional view of a dual portion label in the label matrix taken along line 6—6 of FIG. 1.

It should also be noted that the perforation 39 is not directly over an edge 86 of the release sheet portion 46. As can be seen most clearly in FIG. 6, the perforation 39 is slightly left of the edge 86 of the release sheet portion 46.

Without further elaboration, the foregoing will so fully illustrate our invention that others may, by applying current or future knowledge, readily adopt the same for use under various conditions of service.

We claim:

1. A label comprising:

a first portion having a first front portion and a first back portion wherein said first back portion is adapted for coupling to one item;

a second portion, severable from said first portion, said second portion having a second front portion and a second back portion wherein said second back portion is adapted for coupling to a second item; and said second front portion comprising information thereon that is covered by an opaque layer that can be removed for revealing said information.

2. The label of claim 1 wherein said first back portion comprises an adhesive.

3. The label of claim 1 wherein said second back portion comprises an adhesive and release layer.

4. The label of claim 1 wherein said second front portion may contain indicia different from said information on said first front portion.

5. The label of claim 1 wherein said opaque layer can be scratched off of said second front portion to reveal said information.

6. The label of claim 1 wherein said first portion and said second portion are severably coupled to each other through a perforation.

7. The label of claim 1 wherein said second portion comprises a substantially rectangular shape and a release layer adhesively-coupled to said second back portion and wherein said release layer also comprises a substantially rectangular shape, said second portion's substantially rectangular shape having a long side length that is shorter than the long side length of said release layer's substantially rectangular shape to form a projecting portion of said release layer that can be seized by a person to remove said release layer form said second portion.

8. A matrix for providing at least one dual portion label that is adapted for removal therefrom for coupling to an item, said matrix comprising:

a face stock releasably attached to a release sheet;

said face stock being cut to form the perimeter of said at least one dual portion label, said face stock within said perimeter being perforated to form a first label portion and a second label portion, said second label portion being severable from said first label portion once said at least dual portion label is removed from said matrix;

said release sheet having a release sheet portion that is releasably coupled to said second label portion, said release sheet portion being releasably interconnected with said release sheet; and said second label portion comprising information thereon that is covered by an opaque layer that can be removed for revealing said information.

9. The matrix of claim 8 wherein said release sheet portion comprises a periphery and wherein said periphery is releasably interconnected with said release sheet at discrete locations.

10. The matrix of claim 9 wherein said discrete locations comprise unsevered portions of said release sheet.

11. The matrix of claim 8 wherein said perimeter has a substantially rectangular shape and wherein said perforation is provided in said face stock within said perimeter parallel to the short side of said rectangular shape.

12. The matrix of claim 8 wherein said second portion comprises a substantially rectangular shape and wherein said release sheet portion also comprises a substantially rectangular shape, said second portion's substantially rectangular shape having a short side length that is shorter than the short side length of said release sheet portion's substantially rectangular shape.

13. The matrix of claim 8 wherein second portion comprises a substantially rectangular shape and wherein said release sheet portion also comprises a substantially rectangular shape, said second portion's substantially rectangular shape having a long side length that is shorter than the long side length of said release sheet portion's substantially rectangular shape to form a projecting portion of said release sheet portion that can be seized by a person to remove said release sheet portion from said second portion.

* * * * *